US008611773B2

(12) United States Patent
Iwasaki

(10) Patent No.: US 8,611,773 B2
(45) Date of Patent: Dec. 17, 2013

(54) IMAGE-FORMING APPARATUS

(75) Inventor: Jin Iwasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 293 days.

(21) Appl. No.: 13/221,402

(22) Filed: Aug. 30, 2011

(65) Prior Publication Data

US 2012/0213552 A1 Aug. 23, 2012

(30) Foreign Application Priority Data

Feb. 18, 2011 (JP) ..... 2011-033381

(51) Int. Cl.
*G03G 15/02* (2006.01)

(52) U.S. Cl.
CPC ..... *G03G 15/0225* (2013.01); *G03G 15/0266* (2013.01); *G03G 15/0216* (2013.01)
USPC ..... 399/50; 399/174; 399/89

(58) Field of Classification Search
USPC ..... 399/50, 174
See application file for complete search history.

(56) References Cited

U.S. PATENT DOCUMENTS

| | | | | |
|---|---|---|---|---|
| 7,457,555 | B2 | 11/2008 | Nakamura | |
| 7,639,960 | B2 * | 12/2009 | Kobashi et al. | 399/50 |
| 7,764,888 | B2 * | 7/2010 | Hagiwara et al. | 399/44 |
| 2005/0220470 | A1 | 10/2005 | Hirota et al. | |

FOREIGN PATENT DOCUMENTS

| | | | |
|---|---|---|---|
| JP | 2008-070637 | A | 3/2008 |
| JP | 2008-145849 | A | 6/2008 |

* cited by examiner

*Primary Examiner* — Walter L Lindsay, Jr.
*Assistant Examiner* — Philip Marcus T Fadul
(74) *Attorney, Agent, or Firm* — Sughrue Mion, PLLC

(57) ABSTRACT

An image-forming apparatus includes an image carrier that has an electrically chargeable film formed on a surface thereof and that carries an image and a charging section that charges a surface of the film on the image carrier. The charging section includes a first charging member that applies a direct-current voltage between the first charging member and the image carrier and a second charging member that applies a direct-current voltage between the second charging member and the image carrier to charge the film on the image carrier to a predetermined surface potential after the first charging member charges the film on the image carrier. The voltage applied by the first charging member is decreased such that the surface potential of the image carrier after the voltage is applied by the first charging member is decreased as the film on the image carrier becomes thinner.

8 Claims, 6 Drawing Sheets

IMAGE-FORMING APPARATUS

CROSS-REFERENCE TO RELATED APPLICATIONS

This application is based on and claims priority under 35 USC 119 from Japanese Patent Application No. 2011-033381 filed Feb. 18, 2011.

BACKGROUND

The present invention relates to image-forming apparatuses.

SUMMARY

According to an aspect of the invention, there is provided an image-forming apparatus including an image carrier that has an electrically chargeable film formed on a surface thereof and that carries an image and a charging section that charges a surface of the film on the image carrier. The charging section includes a first charging member that applies a direct-current (DC) voltage between the first charging member and the image carrier and a second charging member that applies a DC voltage between the second charging member and the image carrier to charge the film on the image carrier to a predetermined surface potential after the first charging member charges the film on the image carrier. The voltage applied by the first charging member is decreased such that the surface potential of the image carrier after the voltage is applied by the first charging member is decreased as the film on the image carrier becomes thinner.

BRIEF DESCRIPTION OF THE DRAWINGS

Exemplary embodiment(s) of the present invention will be described in detail based on the following figures, wherein.

DETAILED DESCRIPTION

First Exemplary Embodiment

Exemplary embodiments of the present invention will now be described with reference to the drawings.

Figure 1:
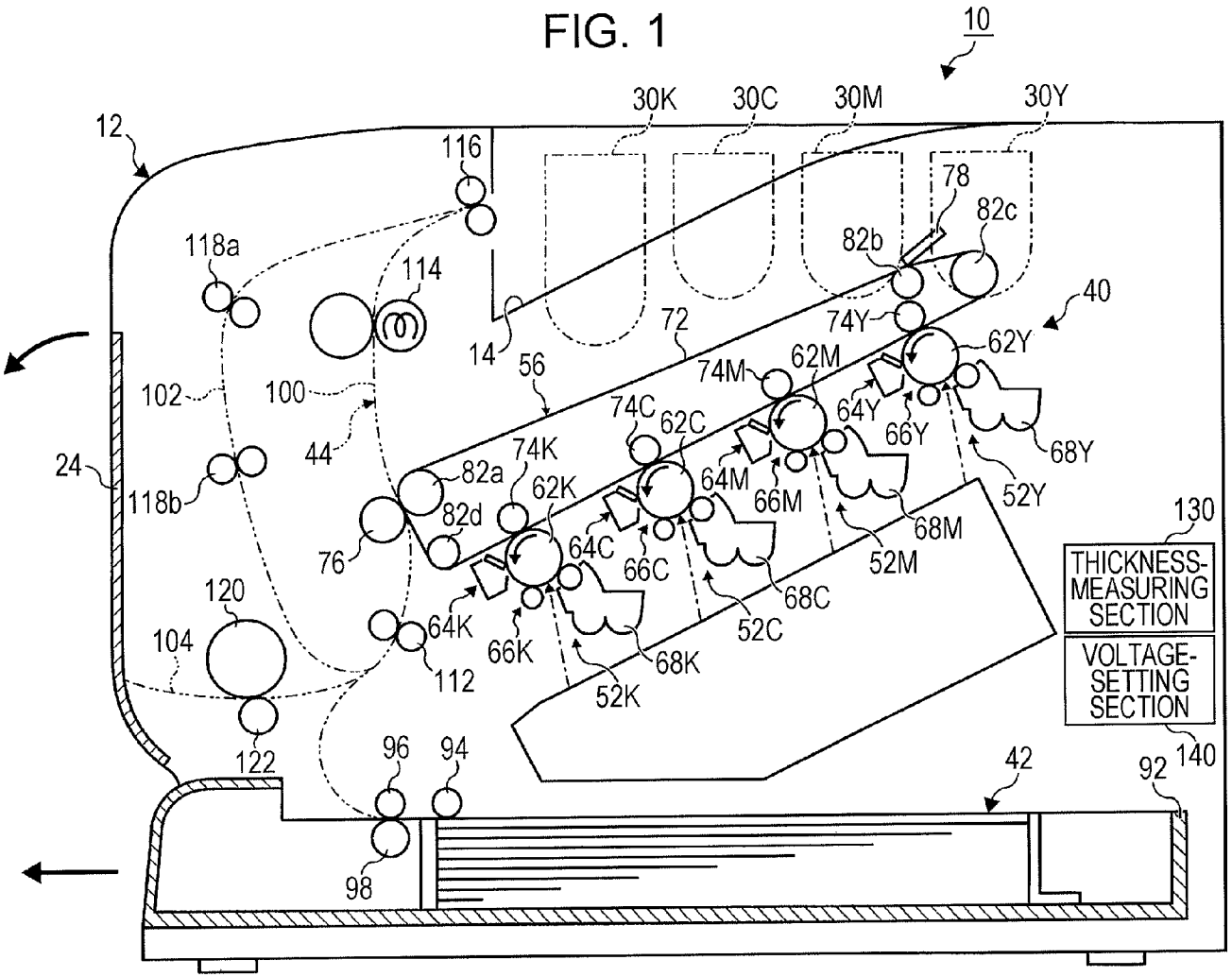
FIG. 1 is a sectional view of an image-forming apparatus according to a first exemplary embodiment of the invention as viewed from the side thereof.

FIG. 1 is a sectional view of an image-forming apparatus 10 according to a first exemplary embodiment of the invention as viewed from the side thereof.

The image-forming apparatus 10 includes an image-forming apparatus body 12. The top of the image-forming apparatus body 12 is used as an eject section 14 to which a recording medium having an image formed thereon is ejected.

The image-forming apparatus body 12 includes an opening/closing part (not shown) for attachment and an opening/closing part 24 for paper supply, both of which can be opened and closed relative to the image-forming apparatus body 12.

The opening/closing part for attachment is opened when storage containers 30Y, 30M, 30C, 30K, used as image-forming-agent storage containers, are attached to and detached from the interior of the image-forming apparatus body 12, and is closed when an image is formed.

The opening/closing part 24 for paper supply is opened when recording media are supplied from the front of the image-forming apparatus body 12.

The storage containers 30Y, 30M, 30C, 30K contain yellow (Y), magenta (M), cyan (C), and black (K) toners, respectively, used as image-forming agents.

The storage containers 30Y, 30M, and 30C have the same shape and size and can contain substantially the same volume of toner.

The storage container 30K is longer in the vertical direction and has a larger volume than the storage containers 30Y, 30M, and 30C. Accordingly, the storage container 30K can contain a larger volume of toner than the storage containers 30Y, 30M, and 30C.

The storage container 30K differs from the storage containers 30Y, 30M, and 30C in the volume of toner that can be contained, but has the same components and functions.

Provided in the image-forming apparatus body 12 are an image-forming section 40, a recording medium supply device 42 that supplies a recording medium to the image-forming section 40, and a transport path 44 along which the recording medium is transported.

The image-forming section 40, the recording medium supply device 42, and the transport path 44 constitute an image-forming system that forms an image on a recording medium.

The image-forming section 40 includes, for example, four image-forming units 52Y, 52M, 52C, 52K, a latent-image forming device 54, and a transfer device 56. The image-forming units 52Y, 52M, 52C, 52K form developer images with Y, M, C, and K toners, respectively.

The image-forming units 52Y, 52M, 52C, 52K correspond to different colors, but have the same structure; they are hereinafter collectively referred to as "image-forming units 52," without the alphabet characters corresponding to the respective colors, namely, Y, M, C, and K. This also applies to other components corresponding to the respective colors (such as storage containers 30 and photoreceptor drum 62).

The image-forming units 52 each include a photoreceptor drum 62 used as an image carrier, a cleaning device 64 that cleans the surface of the photoreceptor drum 62, a charger 66 that charges the photoreceptor drum 62, and a developing device 68 that develops an electrostatic latent image formed on the surface of the photoreceptor drum 62 by the latent-image forming device 54 with a toner to form a toner image.

The developing devices 68 are supplied with the toners of the corresponding colors from the storage containers 30.

The transfer device 56 includes a belt-shaped intermediate transfer member 72 used as a transfer medium, first transfer rollers 74Y, 74M, 74C, and 74K used as first transfer devices, a second transfer roller 76 used as a second transfer device, and a cleaning device 78 that cleans the surface of the intermediate transfer member 72.

The toner images formed on the photoreceptor drums 62 are transferred to the intermediate transfer member 72 so as to be superimposed on each other. The intermediate transfer member 72 is rotatably supported by, for example, four support rollers 82*a*, 82*b*, 82*c*, and 82*d* used as support members.

The first transfer rollers 74Y, 74M, 74C, and 74K transfer the toner images of the individual colors from the photoreceptor drums 62Y, 62M, 62C, and 62K to the intermediate transfer member 72.

The second transfer roller 76 transfers the toner images of the individual colors from the intermediate transfer member 72 to a recording medium.

The recording medium supply device 42 includes a recording medium accommodation container 92 accommodating, for example, recording media stacked on top of each other, a pickup roller 94 that picks up the top recording medium from the recording medium accommodation container 92, a transport roller 96 that transports the recording medium picked up by the pickup roller 94 toward the image-forming section 40, and a separation roller 98 disposed in contact with the transport roller 96 such that the recording medium is separated between the separation roller 98 and the transport roller 96.

The recording medium accommodation container 92 can be drawn, for example, to the front of the image-forming apparatus body 12 (to the left in FIG. 1) for replenishment of recording media.

The transport path 44 includes a main transport path 100, a reverse transport path 102, and an auxiliary transport path 104.

The main transport path 100 is a transport path along which a recording medium supplied from the recording medium supply device 42 is transported to the eject section 14. The main transport path 100 includes, in order from the upstream side in the transport direction of the recording medium, a registration roller 112, the second transfer roller 76, a fixing device 114, and an eject roller 116.

The registration roller 112 starts rotating from rest at a predetermined timing and supplies a recording medium to a position where the intermediate transfer member 72 and the second transfer roller 76 are in contact in synchronization with the timing when toner images are transferred to the intermediate transfer member 72.

The fixing device 114 fixes the toner image transferred to the recording medium by the transfer device 56 on the recording medium.

The eject roller 116 ejects the recording medium having the toner image fixed thereon by the fixing device 114 to the eject section 14. If images are to be formed on both sides of the recording medium, the eject roller 116 rotates in the direction opposite to the direction in which the recording medium is ejected to the eject section 14 to transport the recording medium having the image formed on one side thereof from the rear side to the reverse transport path 102.

The reverse transport path 102 is a transport path along which the recording medium having the image formed on one side thereof is reversed and is transported again upstream of the registration roller 112. The reverse transport path 102 has, for example, two reverse transport rollers 118*a* and 118*b*.

The auxiliary transport path 104 is used to supply a recording medium from the front of the image-forming apparatus body 12, with the opening/closing part 24 for paper supply being open relative to the image-forming apparatus body 12. The auxiliary transport path 104 has an auxiliary transport roller 120 that transports the recording medium toward the registration roller 112 and a separation roller 122 disposed in contact with the auxiliary transport roller 120 to separate the recording medium.

Also provided in the image-forming apparatus body 12 is a thickness-measuring section 130 that measures the thickness (decrease in thickness) of the photoreceptor drums 62.

The thickness-measuring section 130 may measure the thickness of the photoreceptor drums 62 on the basis of measurements such as the number of recording media printed (hereinafter referred to as "number of prints"), the number of rotations of the photoreceptor drums 62, the count of pixels in the images input (pixel count), the number of rotations of toner-carrying members (augers) of the developing devices 68, the amount of toner used, or a combination thereof.

Also provided in the image-forming apparatus body 12 is a voltage-setting section 140 that sets the voltage applied to the charger 600. The voltage-setting section 140 is notified of measurement results from the thickness-measuring section 130.

The voltage-setting section 140 sets the voltage applied on the basis of measurement results from the thickness-measuring section 130.

Next, the image-forming units 52 will be described in detail.

Figure 2:
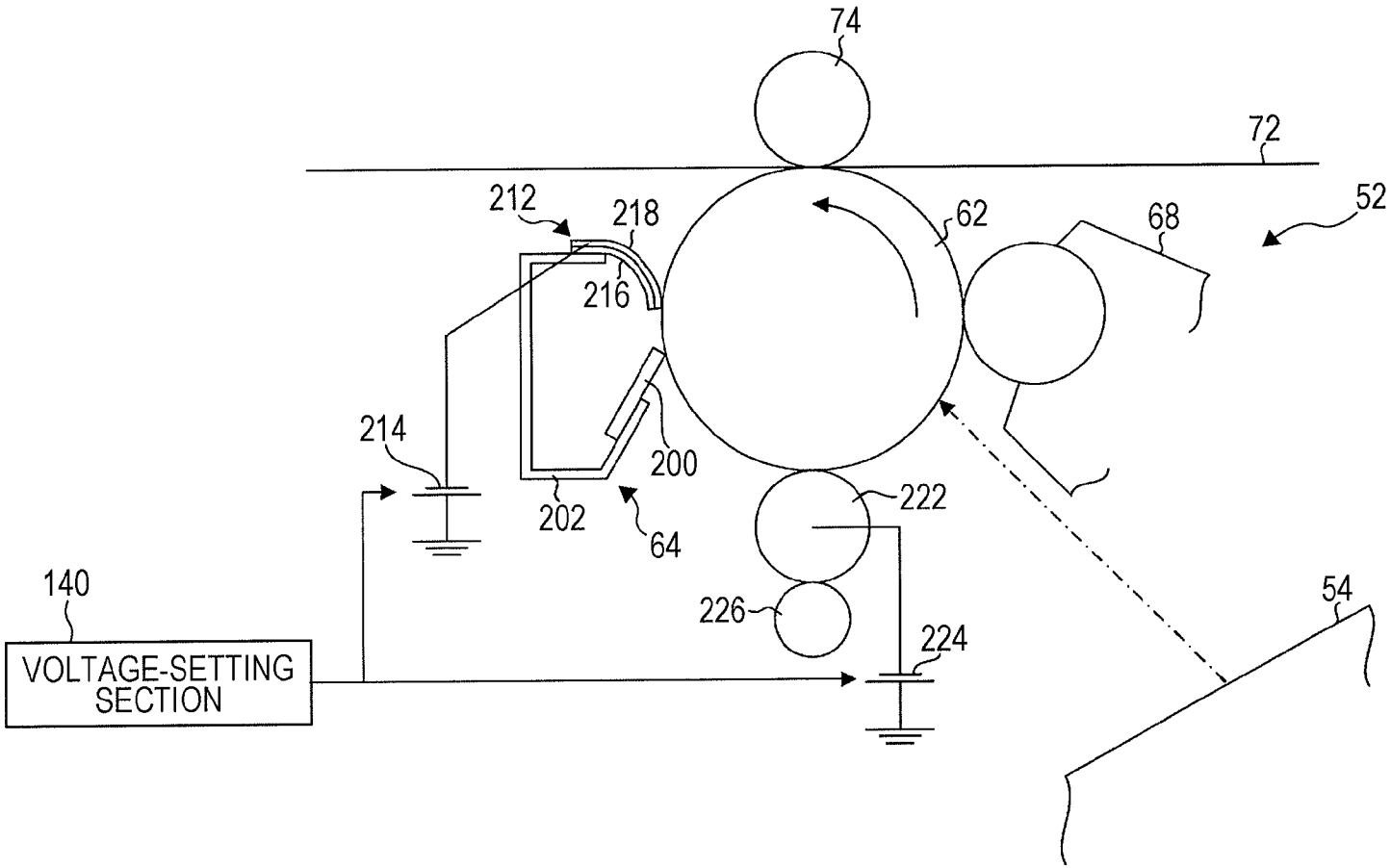
FIG. 2 is a schematic diagram of an image-forming unit according to the first exemplary embodiment of the invention and the surrounding structure.

FIG. 2 is a schematic diagram of an image-forming unit 52 and the surrounding structure.

The photoreceptor drum 62 is surrounded by the cleaning device 64, the charger 66, the developing device 68, and the first transfer roller 74, which is disposed with the intermediate transfer member 72 therebetween.

The cleaning device 64 includes a cleaning blade 200 that removes, for example, residual toner and paper powder from the surface of the photoreceptor drum 62 and a collection container 202 in which the toner removed by the cleaning blade 200 is collected.

The charger 66 includes a first charging member 212 and a second charging member 222 disposed downstream of the first charging member 212 in the rotational direction of the photoreceptor drum 62 (hereinafter also simply referred to as "rotational direction").

The first charging member 212 and the second charging member 222 are disposed in line in the rotational direction of the photoreceptor drum 62.

The side closer to the developing device 68 in the rotational direction is defined as the downstream side in the rotational direction.

In this exemplary embodiment, the first charging member 212 is disposed upstream of the cleaning device 64 in the rotational direction. The first charging member 212 is a charging strip (charging film) that is strip-shaped (film-shaped or substantially film-shaped) and is disposed in contact with the photoreceptor drum 62 to charge the photoreceptor drum 62.

The first charging member 212 may be disposed so close to the photoreceptor drum 62 that discharge occurs therebetween.

The first charging member 212 also functions as a leakage-preventing member that prevents leakage of the toner collected in the collection container 202.

The first charging member 212 has a first applying section 214 that applies a voltage to the first charging member 212. The first applying section 214 is configured such that the voltage applied to the first charging member 212 is set by the voltage-setting section 140.

The first charging member 212 includes a film-shaped or substantially film-shaped substrate 216 and a coating 218 formed on one side of the substrate 216 and disposed in contact with the photoreceptor drum 62.

The substrate 216 is, for example, a plastic film subjected to conductivity treatment. The substrate 216 is formed of, for example, polyester, polyethylene, polypropylene, polycarbonate, polyimide, cellulose, or nylon.

The resistance of the substrate 216 is, for example, approximately $10^0$ to $10^6$ Ω/sq in terms of the surface resistivity measured while allowing a current to flow in the transverse direction.

Examples of methods for conductivity treatment of plastic films include dispersing a conductive material in a plastic film, applying a conductive paint containing a conductive material to a plastic film, and depositing a metal on a plastic film.

Examples of metals used for deposition include aluminum, gold, copper, titanium, silver, brass, and chromium.

Alternatively, the substrate 216 may be formed of a sheet of, for example, aluminum, stainless steel, or nickel.

The coating 218 contains, for example, an elastic material and a conductor.

Examples of elastic materials for the coating 218 include rubbers such as polyurethane rubber, epichlorohydrin rubber, chlorosulfonated polyethylene, fluororubber, vinyl nitrile rubber, and styrene-butadiene rubber; polycarbonate; acrylic resin; polyamide; polyimide; polystyrene; silicone resin; polyvinyl butyral; polyester; phenolic resin; and melamine resin.

Examples of conductors include electron conductors and ion conductors.

Examples of electron conductors include carbon black such as Ketjen Black and acetylene black; pyrolytic carbon; graphite; conductive metals and alloys such as aluminum, copper, nickel, and stainless steel; conductive metal oxides such as tin oxide, indium oxide, titanium oxide, tin oxide-antimony oxide solid solution, and tin oxide-indium oxide solid solution; and insulating materials having the surfaces thereof subjected to conductivity treatment.

Examples of ion conductors include perchlorates and chlorates of tetraethylammonium and lauryltrimethylammonium; perchlorates and chlorates of alkali metals such as lithium; and perchlorates and chlorates of alkaline earth metals such as magnesium.

Such conductors may be used alone or in a combination of two or more.

The second charging member 222 has a circular or substantially circular cross section (roller shape) and is configured as a charging roller disposed in contact with (or in proximity to) the photoreceptor drum 62 to charge the photoreceptor drum 62.

The second charging member 222 has a second applying section 224 that applies a voltage to the second charging member 222. The second applying section 224 is configured such that the voltage applied to the second charging member 222 is set by the voltage-setting section 140.

The second charging member 222 is disposed so as to charge the photoreceptor drum 62 after the first charging member 212 charges the photoreceptor drum 62.

In addition, the second charging member 222 has a cleaning member 226 that cleans the surface of the second charging member 222. The cleaning member 226 is rotated as the second charging member 222 rotates.

In this exemplary embodiment, the first applying part 214 and the second applying part 215 apply a DC voltage to the first charging member 212 and the second charging member 222, respectively (DC charging system).

Alternatively, the first applying part 214 and the second applying part 215 may apply a DC voltage having an AC voltage superimposed thereon (AC+DC charging system).

The voltage-setting section 140, as described above, is notified of measurement results from the thickness-measuring section 130.

Thus, the voltage-setting section 140 is configured such that it sets the voltages applied to the first charging member 212 and the second charging member 222 on the basis of measurement results from the thickness-measuring section 130.

Next, the second charging member 222 will be described in detail.

Figure 3:
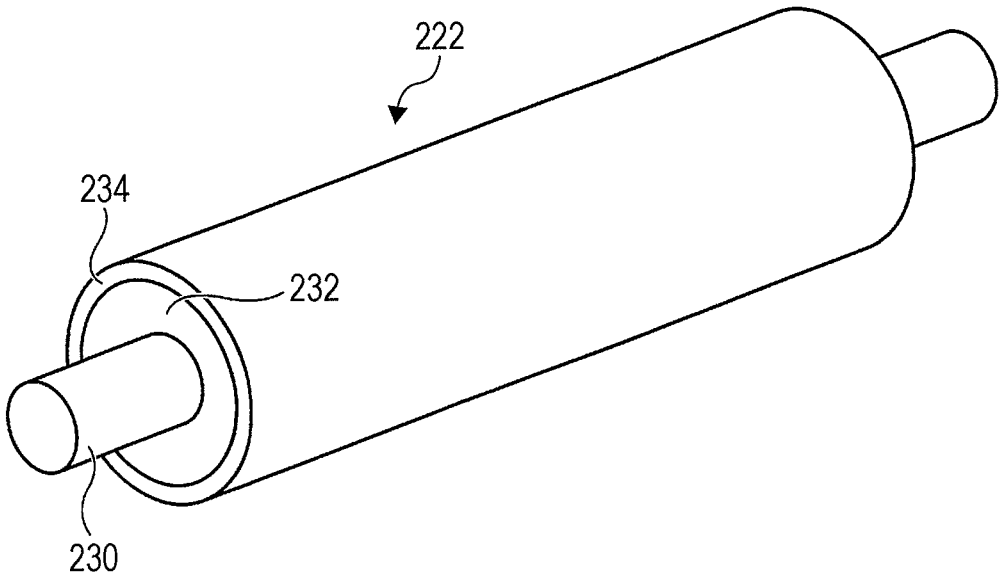
FIG. 3 is a perspective view of a second charging member according to the first exemplary embodiment of the invention.

FIG. 3 is a perspective view of the second charging member 222.

The second charging member 222 includes a core (shaft) 230, an elastic layer 232 disposed on the circumferential surface of the core 230, and a surface layer 234 disposed on the circumferential surface of the elastic layer 232.

The structure of the second charging member 222 is not limited to the above structure. For example, the second charging member 222 may further include an adhesive layer (primer layer) disposed between the core 230 and the elastic layer 232, a resistance-adjusting layer or transfer-preventing layer disposed between the elastic layer 232 and the surface layer 234, and a protective layer (coating layer) disposed outside the surface layer 234.

The core 230 is a bar-shaped conductive member. The core 230 may be either hollow (tubular) or solid.

Examples of materials for the core 230 include metals such as iron, copper, brass, stainless steel, aluminum, and nickel; materials (such as resins and ceramics) having a plated surface; and materials having a conductor dispersed therein.

The elastic layer 232 contains, for example, an elastic material and a conductor. In addition, the elastic layer 232 optionally contains additives.

Examples of elastic materials for the elastic layer 232 include isoprene rubber, chloroprene rubber, epichlorohydrin rubber, butyl rubber, polyurethane, silicone rubber, fluororubber, styrene-butadiene rubber, butadiene rubber, nitrile rubber, ethylene propylene rubber, epichlorohydrin-ethylene oxide copolymer rubber, epichlorohydrin-ethylene oxide-allylglycidyl ether copolymer rubber, ethylene-propylene-diene terpolymer rubber (EPDM), acrylonitrile-butadiene copolymer rubber (NBR), natural rubber, and mixtures thereof.

The elastic material may be either foamed or unfoamed.

Examples of conductors include electron conductors and ion conductors such as those described above.

Examples of additives include softeners, plasticizers, curing agents, vulcanizing agents, vulcanization accelerators, antioxidants, surfactants, coupling agents, and fillers (such as silica and calcium carbonate).

The elastic layer 232 has a thickness of, for example, about 1 to 10 mm and a volume resistivity of, for example, about $10^3$ to $10^{14}$ Ωcm.

The surface layer 234 is formed of, for example, a resin. The surface layer 234 optionally contains roughening particles that roughen the surface layer 234 to a predetermined surface roughness, a conductor, and additives.

Examples of resins include acrylic resins, cellulose resins, polyamide resins, nylon copolymers, polyurethane resins, polycarbonate resins, polyester resins, polyethylene resins, polyvinyl resins, polyarylate resins, styrene butadiene resins, melamine resins, epoxy resins, urethane resins, silicone resins, fluorocarbon resins (such as tetrafluoroethylene-perfluoroalkyl vinyl ether copolymer, ethylene tetrafluoride-propylene hexafluoride copolymer, and polyvinylidene fluoride), and urea resins.

Nylon copolymers contain one or more of nylon-6,10, nylon-11, and nylon-12 as polymer units. Nylon copolymers may also contain, for example, nylon-6 or nylon-6,6 as polymer units.

Further examples of resins include elastic materials used for the elastic layer 232.

Examples of roughening particles include conductive particles and nonconductive particles.

As used herein, the term "conductive" refers to having a volume resistivity of less than $10^{13}$ Ωcm, and the term "nonconductive" refers to having a volume resistivity of $10^{13}$ Ωcm or more.

Examples of conductive particles include conductors used for the elastic layer 232.

Examples of nonconductive particles include resin particles (such as polyimide resin particles, methacrylic resin particles, polystyrene resin particles, fluorocarbon resin particles, and silicone resin particles) and inorganic particles (such as clay particles, kaolin particles, talc particles, silica particles, and alumina particles).

The roughening particles may be formed of the same material as the resin for improved compatibility and adhesion between the roughening particles and the resin.

Examples of conductors and additives used for the surface layer 234 include conductors and additives used for the elastic layer 232.

Next, the photoreceptor drum 62 will be described in detail.

Figure 4:
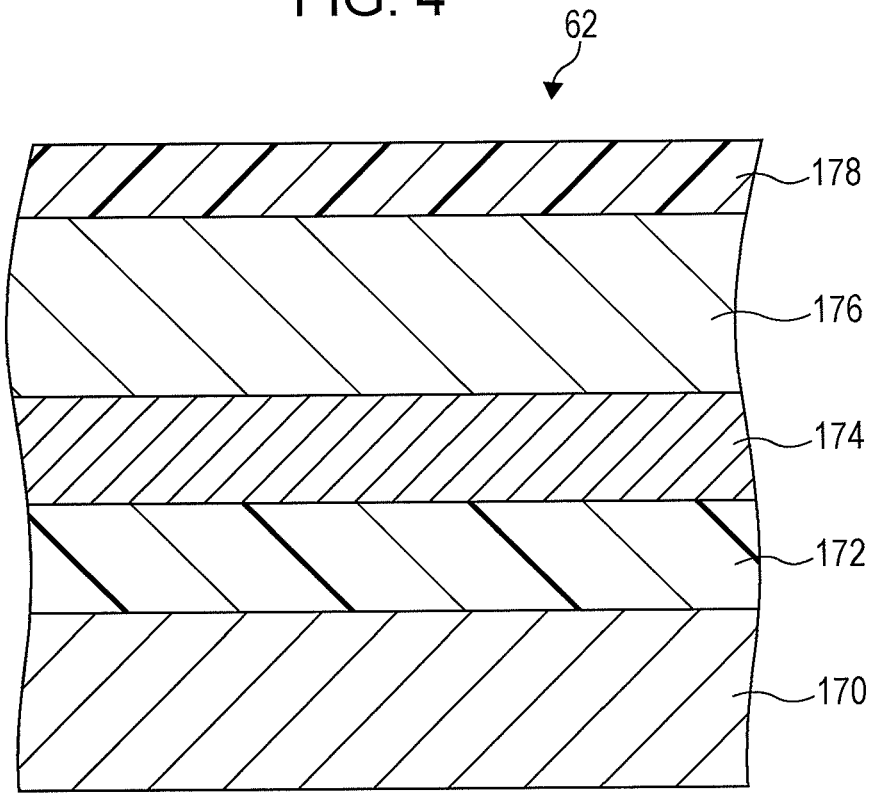
FIG. 4 is an example of a schematic sectional view of a photoreceptor drum according to the first exemplary embodiment of the invention.

FIG. 4 is an example of a schematic sectional view of the photoreceptor drum 62.

The photoreceptor drum 62 includes a conductive substrate 170, an undercoat layer 172 disposed on the conductive substrate 170, and a photosensitive layer disposed on the undercoat layer 172. The photosensitive layer includes a charge generation layer 174, a charge transport layer 176, and a protective layer 178.

Examples of materials for the conductive substrate 170 include metal plates, metal drums, and metal belts formed of a metal or alloy such as aluminum, copper, zinc, stainless steel, chromium, nickel, molybdenum, vanadium, indium, gold, or platinum; and paper or plastic films and belts on which a conductive polymer, a conductive compound such as indium oxide, or a metal or alloy such as aluminum, palladium, or gold is applied, deposited, or laminated.

As used herein, the term "conductive" refers to having a volume resistivity of less than $10^{13}$ Ωcm.

If the photoreceptor drum 62 is used for a laser printer, the calculated average roughness ($Ra_{75}$) of the conductive substrate 170 is adjusted to, for example, 0.04 to 0.5 μm to prevent interference fringes during laser irradiation.

If the calculated average roughness ($Ra_{75}$) falls below 0.04 μm, the interference-preventing effect tends to be insufficient. If the calculated average roughness ($Ra_{75}$) exceeds 0.5 μm, the resulting image tends to be rough.

Examples of methods for adjusting the surface roughness include liquid honing, in which a workpiece is blasted with water having an abrasive suspended therein, centerless grinding, in which a workpiece is continuously ground by pressing it against a rotating abrasive wheel, and anodizing.

Another example is a method in which a conductive or semiconductive powder is dispersed in a resin and is applied to the surface of a workpiece to form a layer having a rough surface in which the particles are dispersed.

The undercoat layer 172 is a layer that imparts antileakage properties and carrier blocking properties.

The undercoat layer 172 contains, for example, a binder resin and inorganic particles.

Examples of binder resins used for the undercoat layer 172 include polymer resin compounds such as acetal resins (e.g., polyvinyl butyral), polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenolic-formaldehyde resins, melamine resins, and urethane resins; electron transport resins having an electron transport group; and conductive resins such as polyaniline.

The undercoat layer 172 may contain various additives for improved electrical properties, improved environmental stability, and improved image quality.

Examples of additives include electron transport pigments such as fused polycyclic pigments and azo pigments, zirconium chelate compounds, titanium chelate compounds, aluminum chelate compounds, titanium alkoxides, organic titanium compounds and silane coupling agents.

Examples of inorganic particles include those having a powder resistance (volume resistivity) of $10^2$ to $10^{11}$ Ωcm.

If the volume resistivity falls below $10^2$ Ωcm, the antileakage properties may be insufficient. If the volume resistivity exceeds $10^{11}$ Ωcm, an increased residual potential may occur.

Examples of inorganic particles include particles of tin oxide, titanium oxide, zinc oxide, and zirconium oxide (conductive metal oxides).

The inorganic particles may be subjected to surface treatment. The inorganic particles may be a mixture of two or more types of inorganic particles, for example, those subjected to different surface treatments or having different particle sizes. The inorganic particles have a volume mean particle size of, for example, 50 to 2,000 nm.

The specific surface area of the inorganic particles based on the BET method is, for example, 10 $m^2/g$ or more. If the specific surface area falls below 10 $m^2/g$, the electrophotographic properties tend to be poor due to degraded chargeability.

The undercoat layer 172 has a Vickers hardness of, for example, 35 or more.

The undercoat layer 172 has a thickness of, for example, 15 to 50 μm.

If the thickness of the undercoat layer 172 falls below 15 μm, the antileakage properties may be insufficient. If the thickness exceeds 50 μm, a residual potential tends to occur after extended use, which may result in abnormal image density.

The charge generation layer 174 contains a charge generation material and a binder resin.

Examples of charge generation materials include azo pigments such as bisazo pigments and trisazo pigments, fused-ring aromatic pigments such as dibromoanthanthrone, perylene pigments, pyrrolopyrrole pigments, phthalocyanine pigments, zinc oxide, and trigonal selenium.

As the charge generation material, for example, an inorganic pigment may be used for a light source having an exposure wavelength of 380 to 500 nm, whereas a metal or nonmetal phthalocyanine pigment may be used for a light source having an exposure wavelength of 700 to 800 nm.

Examples of binder resins used for the charge generation layer 174 include insulating resins and organic photoconductive polymers such as poly-N-vinylcarbazole, polyvinylanthracene, polyvinylpyrene, and polysilane.

Specifically, examples of binder resins include polyvinyl butyral resins, polyarylate resins (such as polycondensates of an aromatic divalent carboxylic acid with a bisphenol), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins, and polyvinylpyrrolidone resins.

These binder resins may be used alone or as a mixture of two or more. The mass ratio of the charge generation material to the binder resin is, for example, 10:1 to 1:10.

As used herein, the term "insulating" refers to having a volume resistivity of $10^{13}$ Ωcm or more.

The charge generation layer 174 has a thickness of, for example, 0.1 to 5.0 μm.

The charge generation layer 174 is formed using a coating liquid prepared by dispersing the charge generation material and the binder resin in a solvent.

Examples of solvents used for dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene, which may be used alone or as a mixture of two or more.

Examples of methods for dispersing the charge generation material and the binder resin in the solvent include ball mill dispersion, attritor dispersion, and sand mill dispersion. Such methods do not change the crystal form of the charge generation material during dispersion.

The charge generation layer 174 is formed by, for example, blade coating, Meyer bar coating, spray coating, dip coating, bead coating, air knife coating, or curtain coating.

The charge transport layer 176 contains a charge transport material and a binder resin, or contains a polymer charge transport material.

Examples of charge transport materials include electron transport compounds such as quinones (e.g., p-benzoquinone, chloranil, bromanil, and anthraquinone), tetracyanoquinodimethanes, fluorenones (e.g., 2,4,7-trinitrofluorenone), xanthones, benzophenones, cyanovinyl compounds, and ethylenic compounds; and hole transport compounds such as triarylamines, benzidines, arylalkanes, aryl-substituted ethylenic compounds, stilbenes, anthracenes, and hydrazones.

These charge transport materials may be used alone or as a mixture of two or more, although the charge transport material used is not limited to the above examples.

Examples of binder resins used for charge transport layer 176 include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenolic-formaldehyde resins, styrene-alkyd resins, poly-N-vinylcarbazole, and polysilane.

These binder resins may be used alone or as a mixture of two or more.

The mass ratio of the charge transport material to the binder resin is, for example, 10:1 to 1:5.

Examples of polymer charge transport materials include poly-N-vinylcarbazole and polysilane. A polymer charge transport material may be used alone or as a mixture with a binder resin.

The charge transport layer 176 has a thickness of, for example, 5 to 50 μm.

The charge transport layer 176 is formed using a coating liquid, for formation of a charge transport layer, containing the above components.

Examples of solvents used for the coating liquid for formation of a charge transport layer include aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. Such organic solvents may be used alone or as a mixture of two or more.

The coating liquid for formation of a charge transport layer is applied to the charge generation layer 174 by a coating process such as blade coating, Meyer bar coating, spray coating, dip coating, bead coating, air knife coating, or curtain coating.

The protective layer 178, which is the outermost layer of the photoreceptor drum 62, is provided to form an outermost surface resistant to damage such as wear and scratches and to increase the toner transfer efficiency.

The protective layer 178 is formed using, for example, a dispersion of conductive particles in a binder resin, a dispersion of lubricating particles, such as fluorocarbon or acrylic particles, in a common charge transport material, or a hard coating agent such as silicone or acrylic. Alternatively, a material having a crosslinked structure or a material containing a readily oxidizable charge transport material may be used in view of strength, electrical properties, or image durability.

Examples of materials having a crosslinked structure include phenolic resins, urethane resins, and siloxane resins.

Thus, the photoreceptor drum 62 has an electrically chargeable film formed on the surface thereof.

The structure of the photoreceptor drum 62 is not limited to the above structure. For example, the photosensitive layer may be provided on the undercoat layer 172 disposed on the conductive substrate 170 by forming the charge transport layer 176, the charge generation layer 174, and the protective layer 178 in the above order.

In addition, the charge generation material and the charge transport material may form a single layer (monolayer photosensitive layer).

In addition, the undercoat layer 172 may be omitted.

Next, experimental results obtained using multiple charging members will be described.

First, charging properties will be described using the photoreceptor drum 62 and the charging members (first charging member 212 and second charging member 222).

Of the charging members, the following description will focus on the first charging member 212, although it also applies to the second charging member 222. In addition, the potential is expressed as a negative value, and the magnitude thereof is represented by the absolute value thereof.

Figure 5:
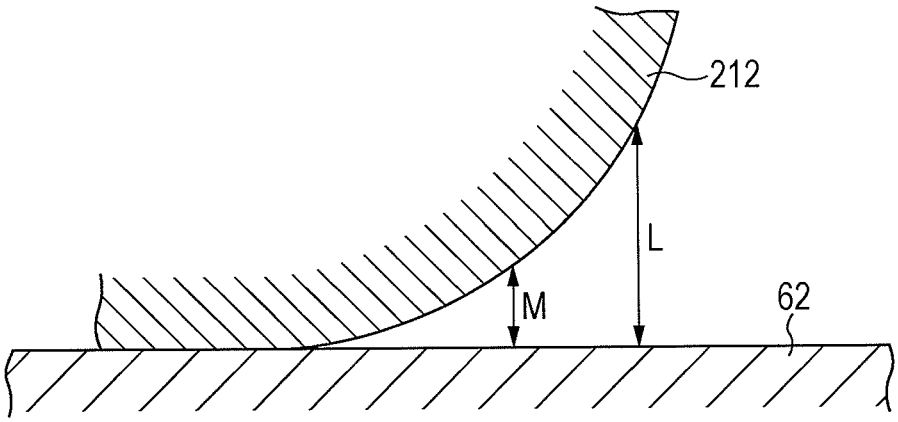
FIG. 5 is a schematic diagram of a position where the photoreceptor drum and a first charging member are in contact and the vicinity thereof.

FIG. 5 is a schematic diagram of a position where the photoreceptor drum 62 and the first charging member 212 are in contact and the vicinity thereof.

Discharge occurs at a position where there is a longer distance between the photoreceptor drum 62 and the first charging member 212 (hereinafter referred to as "gap length") as the voltage for charging the photoreceptor drum 62 (hereinafter referred to as "charging voltage") becomes higher.

As shown in FIG. 5, for example, the gap length L of discharge caused with a charging voltage of −600 V is larger than the gap length M of discharge caused with a charging voltage of −300 V.

In addition, discharge tends to be less stable at a larger gap length.

Accordingly, as the gap length of discharge becomes larger, more defects (i.e., image defects such as lateral streaks) occur during image formation. In particular, more image defects occur as the film on the photoreceptor drum 62 becomes thicker (for example, 25 μm or more).

If the charging voltage is relatively low (for example, about −300 V), fewer image defects occur because the gap length of discharge is relatively small.

In some cases, however, the potential set to the photoreceptor drum 62 (hereinafter referred to as "preset potential") needs to be relatively high (for example, about −600 V), depending on other processes (such as development). In such cases, a high charging voltage results in image defects.

In this exemplary embodiment, multiple (two) charging members (first charging member 212 and second charging member 222) are provided.

Table 1 shows whether or not image defects occur when images are formed at a relatively high preset potential, namely, −600 V, in Example 1 and Comparative Example 1. The potentials shown in Table 1 refer to the surface potentials of the photoreceptor drum 62 at various positions.

In Example 1, multiple (two) charging members are used. For the preset potential, −600 V, the surface potential of the photoreceptor drum 62 as the target for the first charging member 212 (hereinafter referred to as "target potential") is −300 V, and the target potential of the second charging member 222 is −600 V. That is, the surface potential is increased from 0 V to −300 V by the first charging member 212 and from −300 V to −600 V by the second charging member 222.

Thus, the charging potentials of the first charging member 212 and the second charging member 222 are both −300 V, which is relatively low.

In Comparative Example 1, a single charging member (second charging member 222 alone) is used. For the preset potential, −600 V, the surface potential is increased from 0 V to −600 V.

Thus, the charging voltage of the single charging member is −600 V, which is relatively high.

TABLE 1

| | Past first transfer roller | Past first charging member | Past second charging member | Image defects |
|---|---|---|---|---|
| Ex. 1 | 0 V | −300 V | −600 V | Not found |
| Com. Ex. 1 | 0 V | 0 V | −600 V | Found |

As shown in Table 1, no image defects are found in Example 1, whereas image defects are found in Comparative Example 1.

Thus, multiple discharge at smaller gap lengths (lower charging voltages) using multiple charging members prevents image defects even if the preset potential is high.

Next, experimental results obtained with the target potential of the first charging member 212 varied depending on the thickness of the photoreceptor drum 62 will be described.

First, charging properties associated with an increase in the amount of image formed (number of prints) will be described using the first charging member 212 and the second charging member 222.

The surface of a charging member is contaminated with toner with increasing amount of image formed. The contamination is particularly noticeable for a charging member provided with no cleaning member because of cost and spatial constraints.

If the charging member is contaminated, discharge occurs such that the surface potential of the photoreceptor drum 62 deviates locally greatly from the target potential (hereinafter referred to as "abnormal discharge"). For example, even if the target potential is −300 V, the surface potential may become −400 V locally after abnormal discharge.

Abnormal discharge occurs more readily as the charging member is more contaminated.

If multiple charging members are used to charge the photoreceptor drum 62 to the preset potential, the potential of the photoreceptor drum 62 past the first charging member 212 can be adjusted by the second charging member 222 if it falls below the target potential. However, the potential of the photoreceptor drum 62 past the first charging member 212 cannot be adjusted by the second charging member 222 if it exceeds the preset potential.

For example, assuming that the preset potential is −600 V and the target potential of the first charging member 212 is −300 V, the surface potential of the photoreceptor drum 62 past the first charging member 212 cannot be decreased by the second charging member 222 if the potential becomes −700 V after abnormal discharge.

Accordingly, the target potential of the first charging member 212 needs to be decreased as the charging members are more contaminated. Thus, if the target potential of the first charging member 212 is decreased relative to the preset potential, the surface potential is prevented from exceeding the preset potential after abnormal discharge.

For example, if the preset potential is −600 V and the target potential is −100 V, the surface potential is less likely to exceed the preset potential after abnormal discharge than if the target potential is −300 V.

On the other hand, as described above, more image defects occur depending on the gap length of discharge as the film on the photoreceptor drum 62 becomes thicker. In other words, fewer image defects occur despite a large gap length of discharge as the film on the photoreceptor drum 62 becomes thinner.

Accordingly, the gap length of discharge may be larger if the film on the photoreceptor drum 62 is thinner than if the film on the photoreceptor drum 62 is thicker (fewer image defects occur despite a large gap length of discharge).

For example, if the film on the photoreceptor drum 62 is thin (for example, about 15 μm), no image defects occur even if the target potential of the first charging member 212 is −500 V in a situation where if the film on the photoreceptor drum 62 is thick (for example, about 25 μm), image defects occur if the target potential exceeds −300 V.

As the amount of image formed on the photoreceptor drum 62 increases, the film on the photoreceptor drum 62 becomes thinner (decrease in thickness), and the surface of the charging member is more contaminated.

Thus, the thickness of the film on the photoreceptor drum 62 and the contamination of the surface of the charging member are associated with each other.

In this exemplary embodiment, the thickness of the film on the photoreceptor drum 62 is measured by the thickness-measuring section 130, and the voltages applied to the photoreceptor drum 62 by the first charging member 212 and the second charging member 222 are set on the basis of the results from the measurement.

Table 2 shows whether or not image defects occur when images are formed at a relatively high preset potential, namely, −600 V, by rotating the photoreceptor drum 62 a predetermined number of times (continuing printing to a predetermined number of prints) in Example 2 and Comparative Example 2.

In Example 2, the voltage applied by the first charging member 212 is decreased such that the target voltage thereof is decreased as the film on the photoreceptor drum 62 becomes thinner, whereas the voltage applied by the second charging member 222 is adjusted such that the target voltage thereof is constant irrespective of the thickness of the film on the photoreceptor drum 62.

In Comparative Example 2, the voltages applied by the first charging member 212 and the second charging member 222 are adjusted such that the target voltages thereof are constant irrespective of the thickness of the film on the photoreceptor drum 62.

TABLE 2

| | Thickness of film on photoreceptor drum (μm) | Number of rotations of photoreceptor drum (kcyc) | Target potential of first charging member (V) | Target potential of second charging member (V) | Image defects |
|---|---|---|---|---|---|
| Ex. 2 | 22≤ | 0 to 300 | −300 | −600 | Not found |
| | 17≤, <22 | 301 to 600 | −200 | −600 | Not found |
| | <17 | 601 to 1,000 | −100 | −600 | Not found |
| Com. Ex. 2 | 22≤ | 0 to 300 | −300 | −600 | Not found |
| | 17≤, <22 | 301 to 600 | −300 | −600 | Found |
| | <17 | 601 to 1,000 | −300 | −600 | Found |

As shown in Table 2, no image defects are found in Example 2, whereas image defects are found in Comparative Example 2 after the thickness of the film on the photoreceptor drum 62 falls below 22 μm.

Thus, setting the voltage applied by the first charging member 212 so as to change the target potential thereof depending on the thickness of the film on the photoreceptor drum 62 prevents image defects.

The conditions such as the initial thickness of the film on the photoreceptor drum 62 and the thresholds of the thickness of the film on the photoreceptor drum 62 at which the target potential of the first charging member 212 is changed are not limited to those of the above exemplary embodiment, but may be appropriately changed depending on the purpose.

Although the voltage-setting section 140 sets the voltages applied by the first charging member 212 and the second charging member 222 depending on the thickness of the film on the photoreceptor drum 62 in the exemplary embodiment described above, the operator may instead set the voltages applied by the first charging member 212 and the second charging member 222.

Although the first charging member 212 used in the exemplary embodiment described above is a charging film, another type of charging member, such as a charging brush, may be used instead.

Second Exemplary Embodiment

Next, a second exemplary embodiment of the invention will be described.

Figure 6:
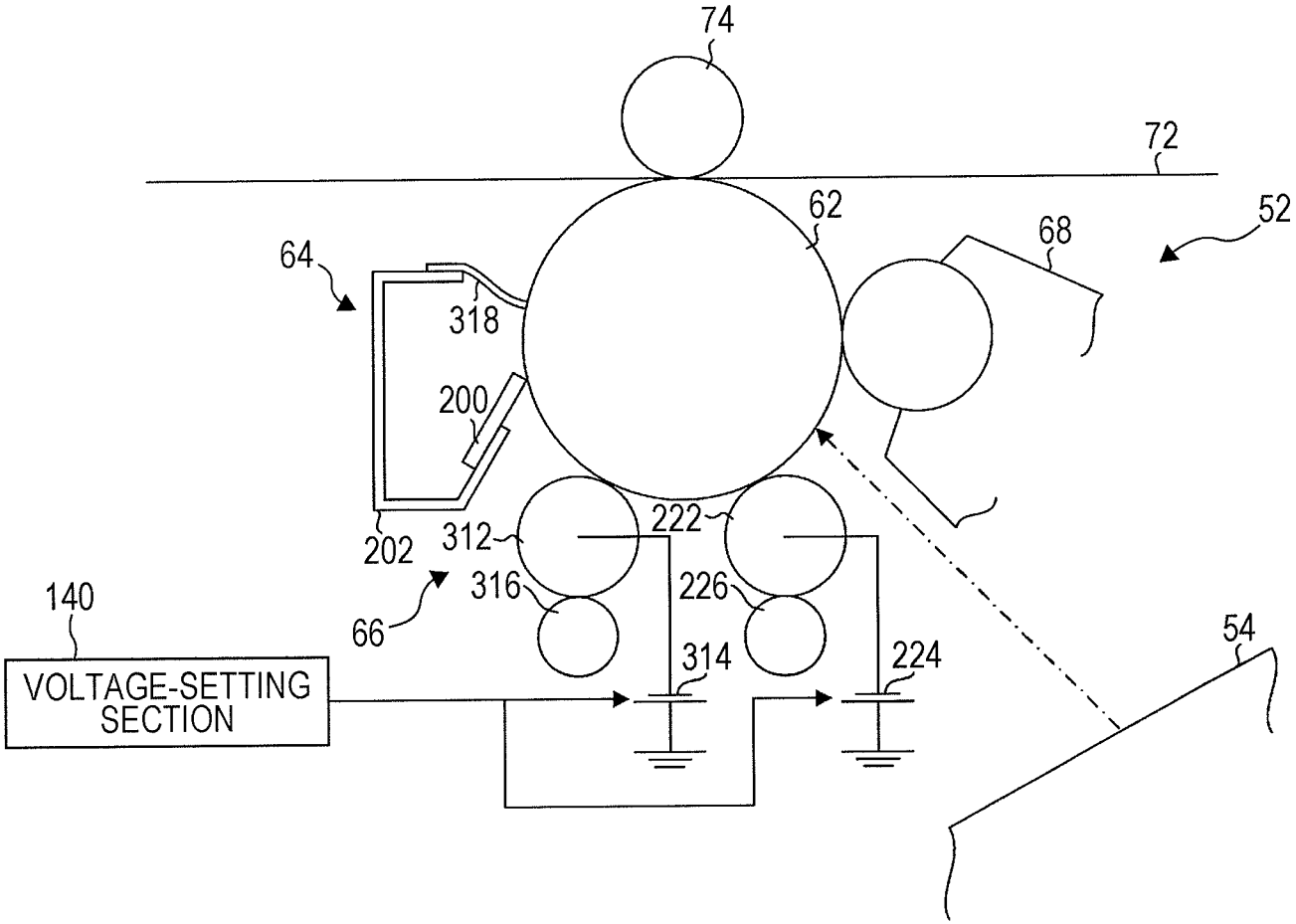
FIG. 6 is a schematic diagram of an image-forming unit according to a second exemplary embodiment of the invention and the surrounding structure.

FIG. 6 is a schematic diagram of an image-forming unit 52 according to the second exemplary embodiment and the surrounding structure.

In the second exemplary embodiment, the charger 66 includes a first charging member 312 and the second charging member 222, which is disposed downstream of the first charging member 312 in the rotational direction of the photoreceptor drum 62.

The first charging member 312 is disposed downstream of the cleaning device 64 and upstream of the second charging member 222 in the rotational direction. The first charging member 312 has a roller shape and is configured as a charging roller disposed in contact with (or in proximity to) the photoreceptor drum 62 to charge the photoreceptor drum 62.

The first charging member 312 has the same structure as the second charging member 222 (see FIG. 5).

The first charging member 312 has a first applying section 314 that applies a voltage to the first charging member 312, and the second charging member 222 has the second applying section 224. The first applying section 314 and the second applying section 224 are configured such that the voltages applied to the first charging member 312 and the second charging member 222, respectively, are set by the voltage-setting section 140.

In addition, the first charging member 312 has a cleaning member 316 that cleans the surface of the first charging member 312. The cleaning member 316 is rotated as the first charging member 312 rotates.

In the second exemplary embodiment, the collection container 202 of the cleaning device 64 has a leakage-preventing member 318 that prevents leakage of toner collected in the collection container 202.

Third Exemplary Embodiment

Next, a third exemplary embodiment of the invention will be described.

Figure 7:
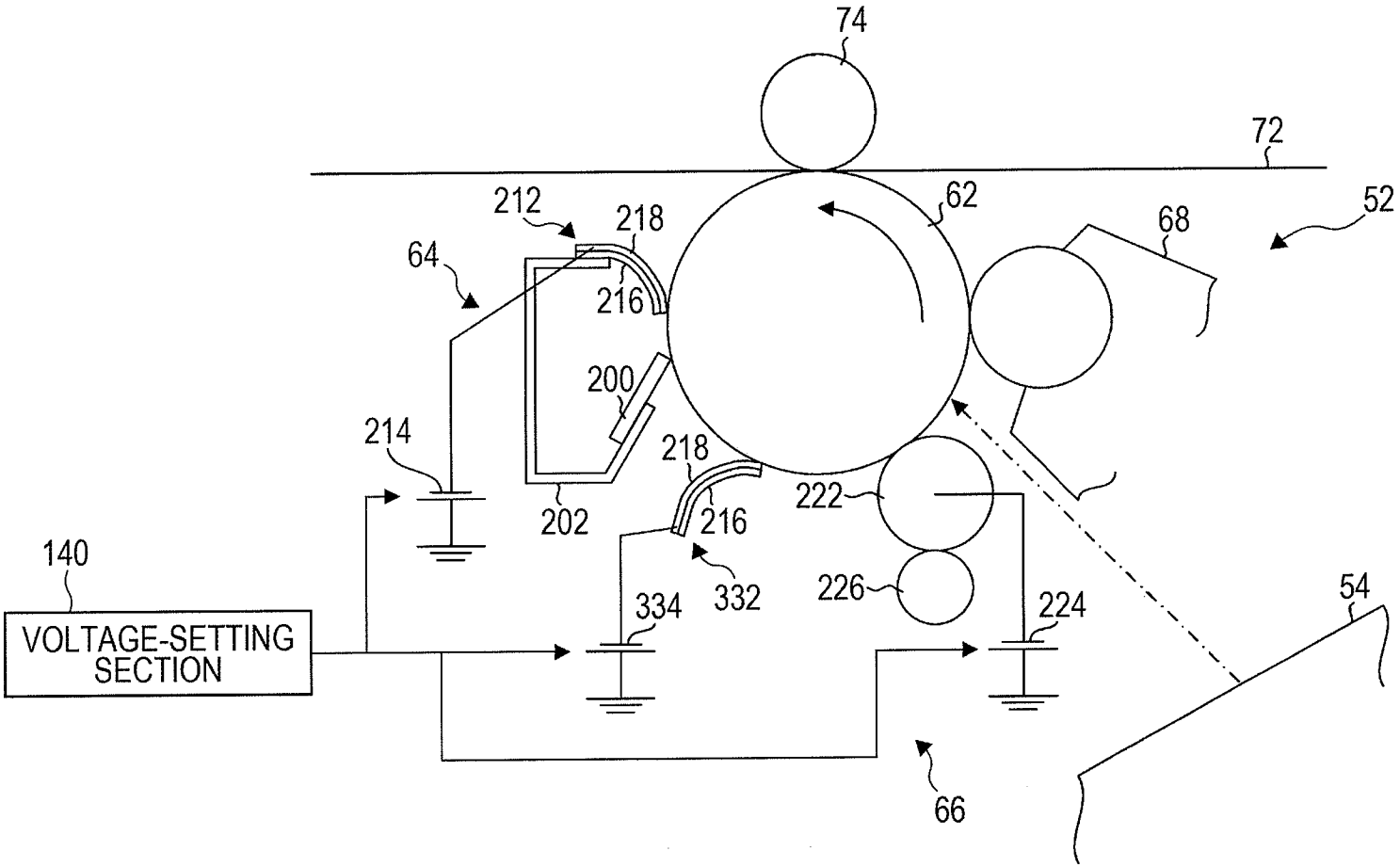
FIG. 7 is a schematic diagram of an image-forming unit according to a third exemplary embodiment of the invention and the surrounding structure.

FIG. 7 is a schematic diagram of an image-forming unit 52 according to the third exemplary embodiment and the surrounding structure.

In the third exemplary embodiment, the charger 66 includes the first charging member 212, the second charging member 222 disposed downstream of the first charging member 212 in the rotational direction of the photoreceptor drum 62, and a third charging member 332.

The third charging member 332 is disposed downstream of the cleaning device 64 and upstream of the second charging member 222 in the rotational direction. The third charging member 332 is a charging film that is film-shaped or substantially film-shaped and is disposed in contact with (or in proximity to) the photoreceptor drum 62 to charge the photoreceptor drum 62.

As with the first charging member 212, the third charging member 332 includes a substrate 216 and a coating 218.

The third charging member 332 has a third applying section 334 that applies a voltage to the third charging member 332. The third applying section 334 is configured such that the voltage applied to the third charging member 332 is set by the voltage-setting section 140.

In the third exemplary embodiment, the voltages applied to the first charging member 212, the second charging member 222, and the third charging member 332 are set on the basis of measurement results from the thickness-measuring section 130.

Specifically, the voltages applied to the first charging member 212, the second charging member 222, and the third charging member 332 are changed such that the target potentials of the first charging member 312 and the third charging member 332 are decreased as the thickness of the film on the photoreceptor drum 62 becomes thinner and that the target potential of the second charging member 222 is maintained at the preset potential.

With more charging members, the voltages applied thereto may be set such that multiple discharge occurs at smaller gap lengths (lower charging voltages) than with fewer charging members.

For example, if the preset potential is −600 V, the surface potential may be increased from 0 V to −200 V by the first charging member 212, from −200 V to −400 V by the third charging member 332, and from −400 V to −600 V by the second charging member 222.

The conditions such as the number, placement, and structure of the charging members are not limited to those of the above exemplary embodiments, but may be appropriately changed depending on the purpose.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

an image carrier that has an electrically chargeable film formed on a surface thereof and that carries an image; and a charging section that charges a surface of the film on the image carrier;

the charging section comprising:

a first charging member that applies a direct-current voltage between the first charging member and the image carrier; and a second charging member that applies a direct-current voltage between the second charging member and the image carrier to charge the film on the image carrier to a predetermined surface potential after the first charging member charges the film on the image carrier;

wherein the voltage applied by the first charging member is decreased such that the surface potential of the image carrier after the voltage is applied by the first charging member is decreased as the film on the image carrier becomes thinner.

2. The image-forming apparatus according to claim 1, wherein the first charging member applies the voltage such that the surface potential of the film on the image carrier is lower than the predetermined potential for the second charging member.

3. The image-forming apparatus according to claim 2, further comprising a third charging member that is disposed between the first charging member and the second charging member and that applies a direct-current voltage between the third charging member and the image carrier, wherein the third charging member applies the voltage such that the surface potential of the film on the image carrier is higher than the potential after the voltage is applied by the first charging member and is lower than the predetermined potential for the second charging member.

4. The image-forming apparatus according to claim 3, wherein the voltages applied by the first charging member and the third charging member are decreased such that the surface potential of the image carrier after the voltages are applied by the first charging member and the third charging member is decreased as the film on the image carrier becomes thinner.

5. The image-forming apparatus according to claim 1, wherein the second charging member has a substantially circular cross section.

6. The image-forming apparatus according to claim 1, further comprising a cleaning section that cleans the second charging member.

7. The image-forming apparatus according to claim 1, wherein the first charging member is substantially film-shaped.

8. The image-forming apparatus according to claim 1, wherein the first charging member has a substantially circular cross section.

* * * * *